US005649807A

United States Patent [19]

Lee et al.

[11] Patent Number: 5,649,807

[45] Date of Patent: Jul. 22, 1997

[54] BLADE CONFIGURATION FOR A VENTILATION FAN

[75] Inventors: Seungbae Lee, Gwacheon; Jin-kyu Choi, Suwon, both of Rep. of Korea

[73] Assignee: Sansung Electronics Co., Ltd., Suwon, Rep. of Korea

[21] Appl. No.: 593,431

[22] Filed: Jan. 29, 1996

[30] Foreign Application Priority Data

May 16, 1995 [KR] Rep. of Korea ..... 1995-12561

[51] Int. Cl.[6] ..... F04D 29/38

[52] U.S. Cl. ..... 416/223 R; 416/234; 416/238; 416/243; 416/DIG. 2; 415/220

[58] Field of Search ..... 416/223 R, 238, 416/DIG. 2, 169 A, 234, 243; 415/119, 220, 223

[56] References Cited

U.S. PATENT DOCUMENTS 4,373,861 2/1983 Papst et al. ..... 415/220

FOREIGN PATENT DOCUMENTS 0516440 9/1955 Canada ..... 416/223 R 0187899 7/1992 Japan ..... 415/119

*Primary Examiner*—Edward K. Look

*Assistant Examiner*—Christopher Verdier

*Attorney, Agent, or Firm*—Burns, Doane, Swecker & Mathis, L.L.P.

[57] ABSTRACT

A structure of a ventilation fan provided with a plurality of blades has a performance curve characterized by a gentle slope throughout the wide operating range instead of an S-hysteresis curve, in order to overcome a fluctuation phenomena of the operating flow rate. The blade tip cross-section lies on a first imaginary cylindrical surface and an angle of attack and pitch angle of the blade tip are formed as respective trajections by intersecting the first cylindrical surface by a second cylindrical surface whose center axis has been rotated about two axes.

3 Claims, 4 Drawing Sheets

FIG. 3
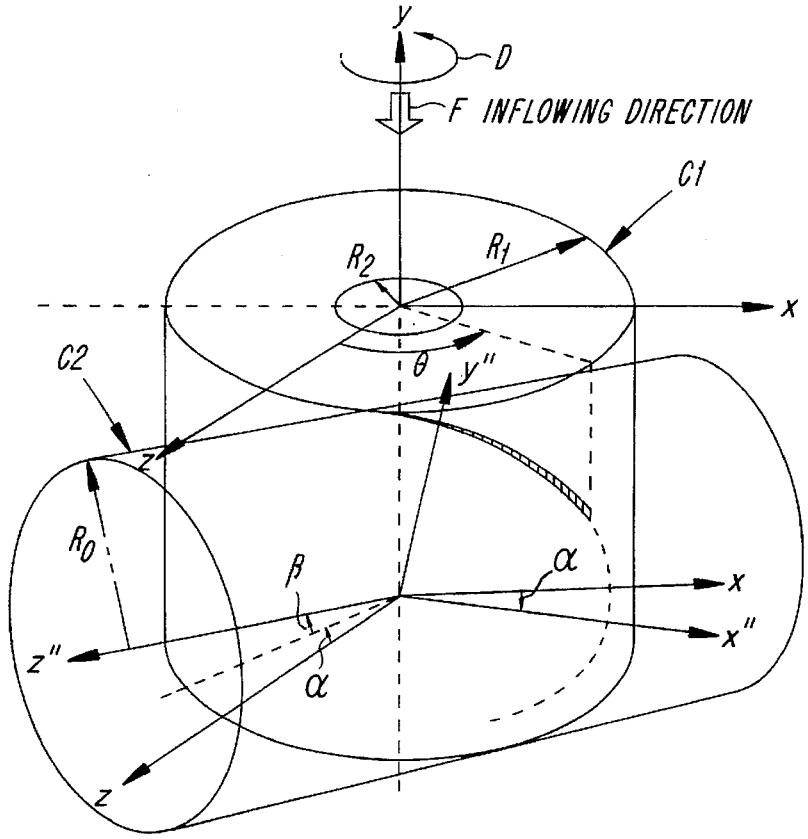
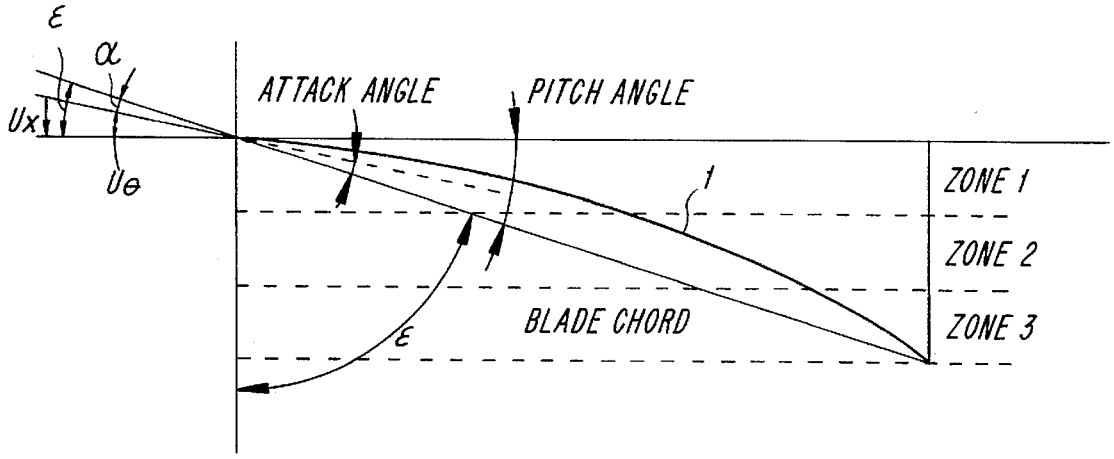
FIG. 4

BLADE CONFIGURATION FOR A VENTILATION FAN

FIELD OF THE INVENTION

The invention relates to a ventilation fan for use in household electrical appliances, and particularly, to a structure of a ventilation fan having an optimum blade section for accomplishing high wind flow and low noise despite the fluctuation of the flow during the operation of the ventilation fan.

BACKGROUND OF THE INVENTION

Ventilation fans have been widely used in the industry, especially in the home appliance business. For example, small cooling fans of the propeller type and the centrifugal type are used for the purpose of cooling and air circulation or ventilation in electric appliances and office automated machines.

As it is well known, the ventilation fan includes an apparatus provided with a number of rotary blades which continuously transfer kinetic energy to air or vapor and raise the pressure of air, etc. There is now the tendency to pursue designs with higher performance and lower noise levels.

In light of these points, there are axial fans designed for realizing low noise as described in Korean Patent Publication No. 88-521 and its corresponding Japanese Patent Publication No. 90-26079. The axial fan includes an axial impeller determining the entire shape thereof by defining the three dimensional distribution with respect to each of the blades' load. In other words, the axial fan is usually constructed to have four or more blades evenly spaced apart from one another (one such blade being shown in FIG. 1), but the blades are arranged in an irregular spacing for the purpose of damping the specific frequency of noises such as Blade Passage Frequency(BPF) component. Also, the axial fan includes blades 1 deposited on a plane disposed at a right angle to a rotating shaft 3. In the coordinate system with the suction direction of an air flow being considered as a positive direction, point $P_R$ is assumed as the center point of the blade line when the blade 1 is cut by a cylindrical surface of radius Rb, while point Pb is assumed as the center point of the blade chord in a cross section when the boss part 2 of the blade is cut by the cylinder surface of radius Rb. And, it is assumed that a distance Ls is formed between the center point $P_R$ of the blade chord Pb and a plane Sc. The center point of the blade chord is continuously positioned in the positive direction for the plane Sc, thereby obtaining an angle of δZ which can be expressed by $\delta Z=\tan^{-1}\{Ls/(R-Rb)\}$ as δZ=12.5°–32.5°. On the other hand, since the blade is projected on a plane disposed at a right angle to the rotary shaft 3, Pb' is assumed as the center point of the blade chord in the cross section, when the boss part 2 is cut by the cylindrical surface of radius Rb. The coordination system is formed to have a straight line connecting a point O with the point Pb' as an X-axis, with a rotary shaft serving as an original point O. At that time, if the blade is cut by the cylinder surface of radius R, then, Pb' is assumed as the center point of the blade chord, and an angle δθ formed by the straight line $P_R'$–0 and the X axis is defined as $\delta\theta=\delta\theta t_x(R-Rb)/(Rt-Rb)$, wherein $R_t$ is a radius of the blade edge, Rb is a radius of the blade boss, δθt is an angle formed by the straight line Pt'–0 and the x-axis, and δθt=40°–50°. In addition, when the axial fan including the blade 1 is assembled into a bell-mouth, as shown in FIG. 2, the blade defines a plane crossing at a right angle with respect to the rotary shaft 3, from which is produced a curved surface of radius BR. The bell-mouth defines a duct having a straight portion ld and an internal diameter DB accommodating an external diameter DT of the fan blade. In the bell-mouth, when there is assumed a distance lx between a trailing edge of the periphery of the blade and the final end of the duct, a relation where BR=0.08 DT–0.2 DT, DB=1.01 DT–0.01 DT, ld=1.04–0.1 DT and lx=0–0.04 DT is obtained.

Accordingly, the flow efficiency and the noise level are determined according to the non-dimensional interval between the bell-mouth and the axial fan, the curvature radius BR of the bell-mouth, and the relative position lx between the fan and the bell-mouth. A characteristic curve demonstrating the incremental changes of the static pressure generated by the fan in relation to the change of the flow rate is shown in FIG. 5. In other words, as the load applied to the fan becomes larger, the flow rate is reduced. If the load is reduced, the increment of the static pressure is reduced and the flow rate is reduced. As shown in FIG. 4, when the cross section of blade 1 is projected in the periphery direction of the fan, assuming that the blade is cut by the cylindrical surface of radius R, the section is developed to a two dimensional plane, obtaining developed figure. In the developed figure. A camber line is formed as a circular arc and if θ is assumed for the center angle, a distribution of θ in the radial direction is given as $\theta(\theta_t-\theta_b)\times\{\{(R-Rb)\}/(Rt-Rb)\}\}+\theta_b$, wherein $\theta_t$ is a camber angle of the blade edge, $\theta_b$ is the camber angle of the blade boss, $\theta_t$ is 20°–30°, $\theta_b$ is 27°–37°, $\theta_t<\theta_b$. Also, an angle ξ is formed by the blade chord and the straight line in parallel to the rotary shaft passing through the leading edge of the blade. Then, the radius direction distribution is given by $\xi=(\xi t-\xi b)\times(R-Rb)/(Rt-Rb)+\xi b$, wherein ξt is a staggering angle at the blade edge, ξb is the staggering angle ato the blade boss, ξt is 62°–72°, ξb is 53°–63° and ξt>ξb. Therefore, if the fan flow rate Q is decreased, the speed component Ux in the axis direction is reduced. An angle of attack between the blade chord and the speed vector is increased, while the lift force is increased, and the static pressure is increased. On the contrary, if the fan flow rate is increased, the angle of attack is reduced and the pressure difference between the fan pressure edge and the absorbing edge is reduced, whereby the lift force is reduced.

Herein, it is noted that the coventional axial flow fan does not cause the asymptotic decay which reduces the load to be applied to the fan like the performance curve of an ordinary small-sized propeller as shown in FIG. 5, but it reduces the flow rate at before and after the normal operation point of the fan and causes the S-hysteresis which decreases the pressure in the performance characteristics. Namely, before and after the normal operation of the fan, the flow rate is changed, thereby producing a bad effect on the cooling performance of an entire system.

Furthermore, the noise level must be reduced near where the air pressure is sharply dropped on the noise spectrum of each load as shown in FIG. 6, but due to the leading edge separation on the pressure surface of a blade the narrow band noise is increased. Consequently, noise is caused near the leading edge of the axial fan due to the erroneously mistaken plate design of the blade section, which results from the S-hysteresis preformance characteristics. In other words, when the small propeller fan is constructed to have a plurality of blades, the blade is designed to be a thin plate in order to minimize the rotary inertia and thus reduce the electric power consumption. Also, as the flow rate is increased, the bell-mouth is positioned at a zone 1, but at that time the pressure at the leading edge is reduced, and also the flow rate is decreased. That is because the leading edge of the blade is designed to be parallel to a plane which is positioned perpendicular to the direction of air inflowing followed by the leading edge flow separation.

Accordingly, the invention is supposed to change the position angle of a blade, thereby improving the unsteady state for the flow rate.

SUMMARY OF THE INVENTION

The invention includes a propellar fan mountable in a bell-mouth and having a plurality of blades, the leading edge of which is in the form of the smooth streamline, thereby minimizing flow loss and reducing noises such as a dipole noise or a narrow band dipole noise etc. generated by the periodic blade loading of the fan which delivers kinetic energy to operation air.

The invention enables a bell-mouth to be positioned in any one of zones 1, 2 and 3 as shown in FIG. 4, thereby increasing a flow rate of a fan under the same load state and removing a phenomena reducing the flow rate due to the blockage of air flow at the cross-section of the bell-mouth.

In light of the foregoing, it is one object of the invention to provide a structure of a ventilation fan comprising a plurality of blades with an optimum cross-section shape by changing the angle of a blade edge, thereby removing the unsteady state for a flow rate and accomplishing the larger flow rate and the lower noise.

The other object of the invention is to provide a structure of a ventilation fan forming a streamline flow passage with a bell-mouth, thereby minimizing the flow loss of air.

In order to acheive the above-mentioned objects, the invention is tested using an ANSI Test Plenum for all small air-moving devices(AMDS) in order to measure the noise level.

Also, the invention is to provide a predetermined shape involved in the change state of a small propeller fan by using the acoustical similarity and the cross-correlation of the hot wire flow velocity meter and microphone in order to study the vortex structure related to the rotating stall therein. Therefore, the invention can realize a structure of a small fan not having the performance curve of the S hysteresis.

In accordance with the invention, a ventilation fan structure is characterized in that the blade tip cross-section of the blade is positioned at the center of the rotary shaft on the cylindrical surface of radius $R_1$, and an angle of attack and a pitch angle of the blade tip cross-section are formed as a trajectory by crossing another cylindrical surface of radius Ro on the cylindrical surface.

BRIEF DESCRIPTION OF THE DRAWINGS

Other features and advantages of the invention will appear from the following descripton in which the preferred embodiments have been set forth in detail, in conjunction with the accompanying drawings.

FIG. 3 is a view illustrating a method for projecting the trajectory of a blade to accomplish a structure of a ventilaton fan according to the principle of the invention;

FIG. 4 is a cross-sectional view of the blade illustrating the correlation of air flows in the blade cross-sections according to the invention;

DETAILED DESCRIPTION OF THE PREFERRED EMBODIMENTS

Referring to FIG. 3, two cylinders C1 and C2 perpendicularly intersect each other. The rotary direction D of an axial fan is counter-clockwise viewing from +y axis, and the flow inflow direction F is toward the −y axis. Radius $R_1$ is the radius of the cylinder C1 and corresponds to the blade tip cross-section and radius $R_2$ is the radius of a blade hub. Radius $R_0$ is a radius of cylinder C2. On the other hand, an angle θ which is an angle disposed in an xz-plane for viewing the blade tip cross-section along the y-axis, is within about 0° to 80°. Also, as the angle θ is symmetrical to the y-axis, it is changable by ±90°, ±180° and ±270°. The cylinder C2 is supposed to meet with the reference surface (θ°=0) of the main cylinder C1 and then travel at an incline through the main cylinder C1 so as to have auxiliary angles α and β. Namely, the cylinder C2 is moved downward from the reference surface, while its coordinate is moved downward in a horizontal plane. Then, cylinder C2 is rotated by the angle α about the y-axis to convert the x-axis into the x"-axis. Then, the cylinder C2 is rotated by the angle β about the x"-axis to create a new z"-axis. Thus, when the blade tip cross-setion is projected on the x and y planes, a trajectory is constituted as a coodinate (x,y) given by the function of the angle θ as follows:

$x=R_1 \sin\theta$ y is obtained by the quadratic equation as follows:

$$Ay^2+By+C=0$$

Herein, $A=\cos^2\beta$, $B=R_1 \sin\alpha \sin\beta \sin\theta-R_1 \cos\alpha \sin^2\beta \cos\theta+2R_0 \cos\beta$ $C=R_1^2(\sin^2\alpha+\cos^2\alpha \sin^2\beta)\cos^2\theta+R_1^2 \sin^2\theta(\cos^2\alpha+\sin^2\alpha \sin^2\beta)+R_1^2 \sin^2\alpha(1-\sin^2\beta)\cdot\sin\theta\cdot\cos\theta+2R_1R_0 \sin\alpha \sin\beta \sin\theta-2R_1R_0 \cos\alpha \sin\beta \cos\theta.$ Herein, the range of $R_0/R_1$ is 0.9–1.1, and α=0°–20° β=0°–10°

In addition, since the main cylinder C1 is symmetrical to y-axis, the angle α becomes negative, i.e., rotation in the counter-clockwise direction. Accordingly, the trajectory determines the optimum blade chord shape.

On the other hand, as shown in FIG. 4, if the blade is reduced by radius r from the y-axis, the flow velocity of air Uθ in the circumferential direction is reduced by Uθ=rw and has a velocity vector identical to an axial velocity Ux. Therefore, in order to maintain an angle of attack equal to that formed by the circumferencial portion, the pitch angle should be increased. For it, radius $R_1$ should be radius r, a value β is increased to be larger than that when the fan radius is r, thereby preventing the performance curve from being the S-shaped hesteresis.

Figure 1:
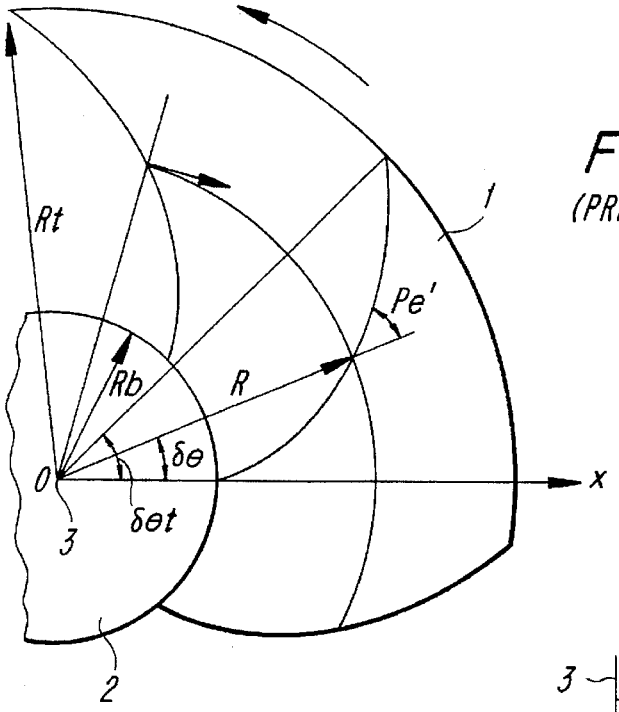
FIG. 1 (PRIOR ART)
FIG. 1 shows a projected state of a blade of a conventional axial fan.
Figure 1A:
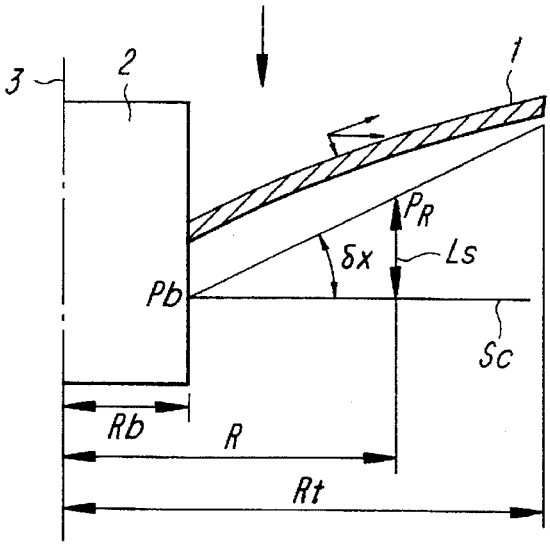
FIG. 1A (PRIOR ART)
FIG. 1A is a cross-sectional view of the conventional blade depicted in FIG. 1.
Figure 2:
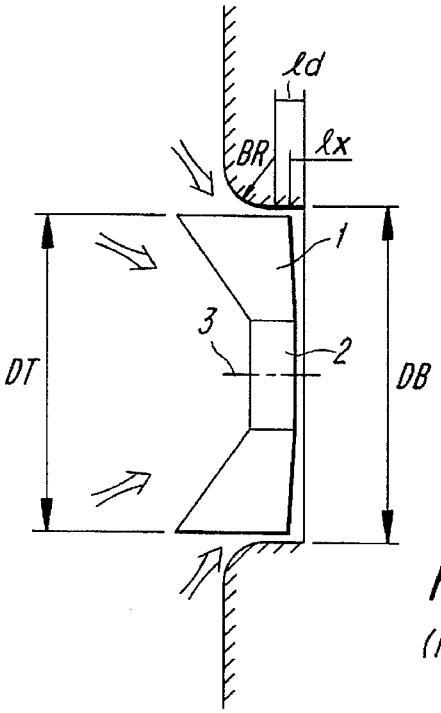
FIG. 2 (PRIOR ART)
FIG. 2 is a view illustrating a relationship between the conventional blade of FIG. 1 and a bell-mouth.
Figure 5:
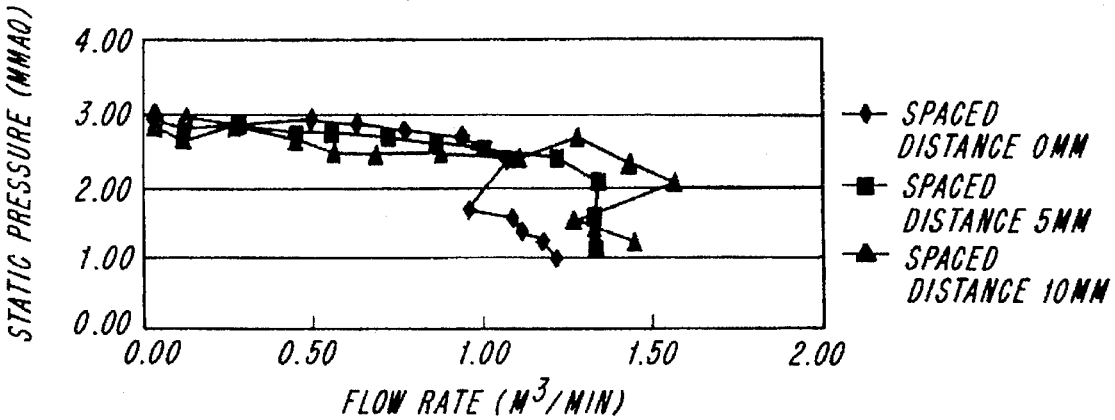
FIG. 5 (PRIOR ART)
FIG. 5 is a graph illustrating the relationship of the flow rate and the static pressure during the operation of the conventonal axial fan.
Figure 6:
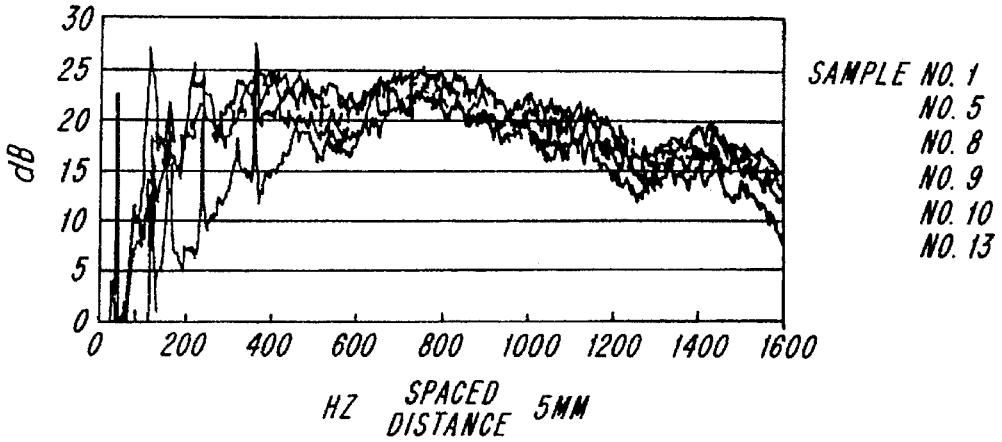
FIG. 6 (PRIOR ART)
FIG. 6 is a graph illustrating noise levels generated by a plurality of the conventional axial fan mounted in the bell-mouth.
Figure 7:
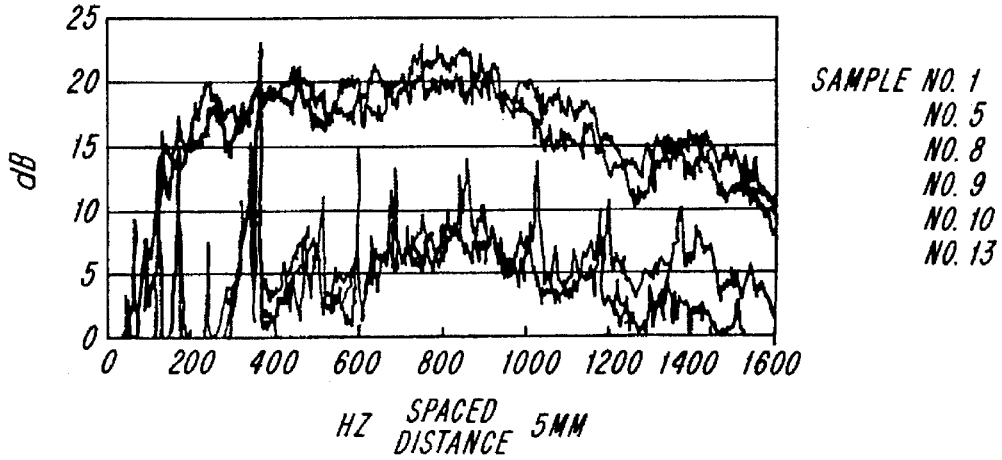
FIG. 7 is a graph illustrating improved noise level generated by a plurality of the ventilation fan of the invention mounted in the bell-mouth; and, FIG. 8 is sowing preferred embodiments of the blade cross-section constructed according to the principle of the invention.
Figure 8:
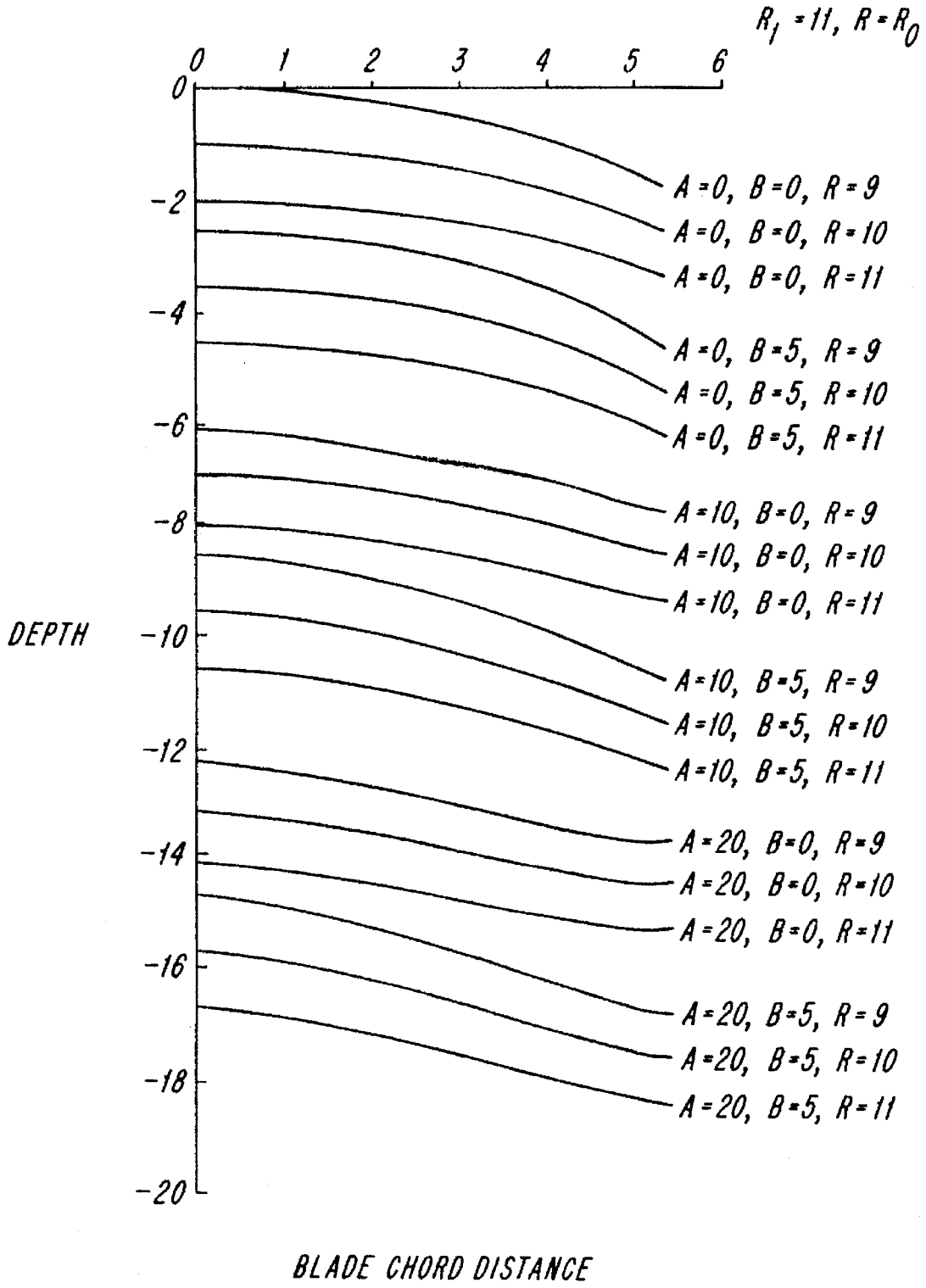

Therefore, as shown in FIG. 8, trajectories projected on the x and y planes are obtained by changing the values of angles $\alpha$ and $\beta$ and $R_0/R_1$. For example, it is noted from FIG. 7 that if a value of $R_0/R_1$(=R) is 0.9, $\alpha$ (=A) is 10° and $\beta$ (=B) is 5°, the leading edge has a large angle of attack of about 10° under the most common used condition of the fan, whereby the static pressure is decreased, the leading edge separation and noise are simmulatneously reduced.

Accordingly, the fan structure according to the invention is constructed so that the blade chord has an angle $\theta$, not a tangential direction angle, in zone 1 of FIG. 4, when the angle $\theta$ is zero, thereby preventing a flow resistance in the passage formed with a bell-mouth from being caused due to the leading edge separation. Also, the angles $\alpha$ and $\beta$ are set to enable an axial fan structure to have the larger lift force within the range of the attack angle of less than 10°. Therefore, it is operable with the noise level being reduced by 2–3 dB over the conventional axial fan.

What is claimed is:

1. A structure of a ventilation fan provided with a plurality of blades is characterized in that a main cylinder and another cylinder intersecting the main cylinder are projected on predetermined planes, whereby a blade tip cross-section is positioned on a surface of the main cylinder having a first radius $R_1$, and an angle of attack and a pitch angle of the blade tip cross-section are horizontally moved relative to the other cylinder having a second radius $R_0$, so as to form a plurality of trajectories, wherein the main cylinder has x, y, and z axes, the y-axis being a center axis of the main cylinder, the other cylinder being rotated by an angle $\alpha$ about the y-axis to reposition the x-axis as an x"-axis displaced by the angle $\alpha$, the other cylinder being also rotated by an angle $\beta$ about the x"-axis to relocate the z-axis as a z"-axis displaced by the angles $\alpha$ and $\beta$, the z"-axis defining a center axis of the other cylinder.

2. The structure of the ventilation fan provided with a plurality of blades as claimed in claim 1, wherein a trajectory of the blade tip is constituted as a coordinate(x,y) given by the function of an angle $\theta$ as follows:

$$x=R_1 \sin\theta$$

$$Ay^2+By+C=0$$

Here, $A=\cos^2\beta$, $$B=R_1 \sin\alpha \sin\beta \sin\theta-R_1 \cos\alpha \sin^2\beta \cos\theta+2R_0 \cos\beta$$

$$C=R_1^2(\sin^2\alpha+\cos^2\alpha \sin^2\beta)\cos^2\theta+R_1^2 \sin^2\theta(\cos^2\alpha+\sin^2\alpha \sin^2\beta)+R_1^2 \sin^2\alpha(1-\sin^2\beta)\cdot\sin\theta\cdot\cos\theta+2R_1R_0 \sin\alpha \sin\beta \sin\theta-2R_1R_0 \cos\alpha \sin\beta \cos\theta.$$

3. The structure of the ventilation fan provided with a plurality of blades as claimed in claim 2, wherein the range of $R_0/R_1$ is 0.9–1.1, $\alpha$ is 0°–20° and $\beta$ is 0°–10°.

* * * * *